United States Patent [19]

Uchida

[11] 4,200,331

[45] Apr. 29, 1980

[54] FOLDING CHAIR

[75] Inventor: Suekichi Uchida, Aichi, Japan

[73] Assignee: Uchida Sharyo Co., Ltd., Nagoya, Japan

[21] Appl. No.: 973,700

[22] Filed: Dec. 27, 1978

[30] Foreign Application Priority Data

Jan. 14, 1978 [JP] Japan ..... 53/3061[U]

[51] Int. Cl.[2] ..... A47C 4/28

[52] U.S. Cl. ..... 297/45; 297/355; 297/52

[58] Field of Search ..... 297/16, 19, 21, 29, 297/45, 52, 355, 356, 366, 372

[56] References Cited

U.S. PATENT DOCUMENTS

| | | | |
|---|---|---|---|
| 488,095 | 12/1892 | Scott et al. | 297/45 X |
| 2,830,653 | 4/1958 | Gaugler | 297/356 X |
| 3,851,914 | 12/1974 | Nii | 297/45 |
| 3,918,822 | 11/1975 | Rauschenberger | 297/355 X |
| 3,941,416 | 3/1976 | Uchida | 297/45 |

FOREIGN PATENT DOCUMENTS

| | | | |
|---|---|---|---|
| 528046 | 4/1954 | Belgium | 297/45 |
| 1049192 | 12/1953 | France | 297/355 |
| 1245366 | 9/1960 | France | 297/45 |

*Primary Examiner*—Ramon S. Britts
*Assistant Examiner*—Peter A. Aschenbrenner
*Attorney, Agent, or Firm*—Frishauf, Holtz, Goodman & Woodward

[57] ABSTRACT

A folding chair comprises a pair of U-shaped tubular legs pivoted to each other at middle points of arm portions thereof, a pair of seat supporting members each having end portions connected to corresponding upper end portions of the respective one of said legs, a collapsible seat stretched between said seat supporting members, arm supporting members provided above said seat supporting members, a pair of arms mounted on the respective arm supporting members, a pair of backrest supporting members each mounted over the respective one of said legs so as to be foldable on said seat supporting members, a collapsible backrest stretched between said backrest supporting members, cylindrical connectors inserted into those end portions of said seat supporting members and those upper end portions of said legs which are adjacent to said backrest supporting members for connecting said seat supporting members to said legs, and a pair of backrest inclination adjusting mechanisms provided between said adjacent end portions of said seat supporting members and lower ends of said backrest supporting members.

7 Claims, 5 Drawing Figures

FOLDING CHAIR

BACKGROUND OF THE INVENTION

This invention relates to a folding chair and more particularly to a folding chair in which the angle of inclination of a backrest thereof can be adjusted.

A known folding chair comprises a pair of legs each made of a U-shaped frame and crossed and pivoted to each other at the front and rear middle frame portions, a pair of seat supporting members extending between the upper end portions of the corresponding legs, a canvas seat stretched between the seat supporting members, arm members provided above the corresponding seat supporting members and extending between the front and rear upper ends of the corresponding legs, a pair of a backrest supporting members with their lower ends fixed to the respective rear upper ends of the legs, and a canvas backrest stretched between the backrest supporting members.

Since the backrest of the known folding chair can not change its inclination but is inclined permanently at a specific angle, the user has to take the same posture on the chair. Further, about 70% of the user's weight exerts on the bolts which fasten the backrest supporting members to the legs. The bolts will therefore be easily fatigued and be broken after a long use of the chair. In addition, the backrest cannot be folded over the seat, and the backrest supporting member remain protruded from the leg members even after the chair has been folded. Thus, the chair remains bulky even if it is folded.

An object of this invention is to provide a folding chair wherein the angle of inclination of a backrest can be easily and securely adjusted, which is durable for a long time since strong connecting means is used to couple the backrest to legs, and which can be made compact when it is folded.

SUMMARY OF THE INVENTION

According to this invention, there is provided a folding chair which comprises a pair of U-shaped tubular legs pivoted to each other at middle points of arm portions thereof, a pair of seat supporting members each having end portions connected to corresponding upper end portions of the respective one of said legs, a collapsible seat stretched between said seat supporting members, a pair of arm supporting members provided above said seat supporting members, a pair of arms mounted on the respective arm supporting members, a pair of backrest supporting members each mounted over the respective one of said legs so as to be foldable on said seat supporting members, a collapsible backrest stretched between said backrest supporting members, cylindrical connectors inserted into those end portions of said seat supporting members and those upper end portions of said legs which are adjacent to said backrest supporting members for connecting said seat supporting members to said legs, and a pair of backrest inclination adjusting mechanisms provided between said adjacent end portions of said seat supporting members and lower ends of said backrest supporting members.

DETAILED DESCRIPTION

Figure 1:
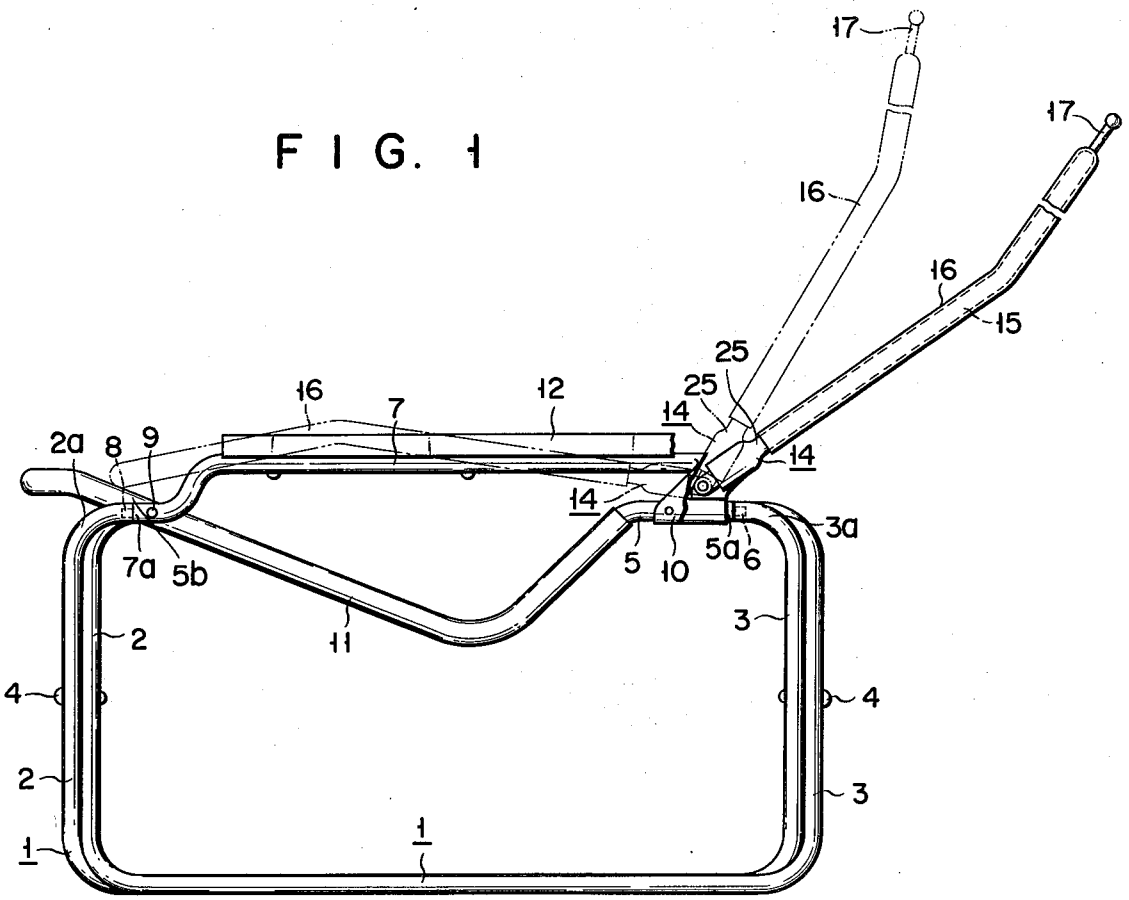
FIG. 1 is a right side elevational view of a folding chair according to this invention.
Figure 2:
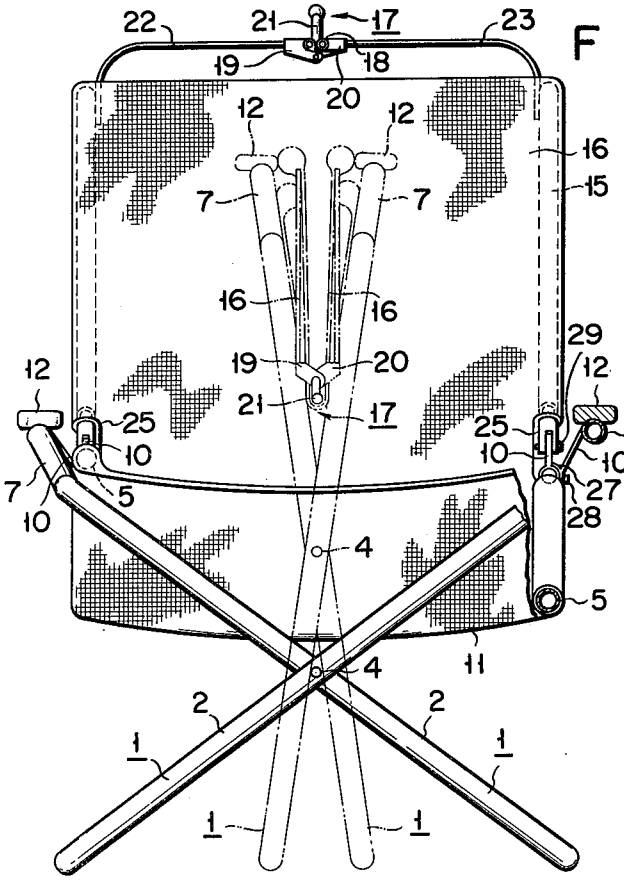
FIG. 2 is a front elevational view of the folding chair of FIG. 1, showing the vertical cross sections of the left arm and the left seat supporting member of the chair.

Referring to FIGS. 1 and 2, a folding chair of the present invention has a pair of legs 1 each made of U-shaped frame such as a steel pipe. The arm portions 2, 3 of each leg 1 intersect with those of the other leg, and the corresponding arm portions are pivoted to each other at their intermediate points by means of pins 4. The upper end portions 2*a* and 3*a* of the arm portions 2 and 3 of each leg 1 are bent outward each other to extend horizontally.

A generally L-shaped seat supporting member 5 made of, for example, a steel pipe has a horizontally extending rear end portion 5*a* connected to the horizontally extending rear upper end portion 3*a* of each leg 1 by means of a connector 6. An L-shaped front end portion 7*a* of a horizontal arm supporting member 7 made of, for example, a steel pipe is connected to the horizontally extending front upper portion 2*a* of each leg 1 by means of a connector 8. Both connectors 6 and 8 are inserted into the rear end portion 5*a* of the seat supporting member 5 and the front end portion 7*a* of the supporting member 7, repectively. The connectors 6 and 8 are either solid cylindrical members or tubular members. The end portions of the connectors 6 and 8 which project from the end portion 5*a*, 7*a* are also inserted into the rear upper end portion 3*a* of the leg 1 and the front upper end portion 2*a* of the leg 1, respectively. Thus, the connectors 6 and 8 effect the connection between the legs 1 and the seat supporting members 5 and between the legs 1 and the arm supporting members 7. The connectors 6 and 8 may be fixed to the end portions 5*a* and 7*a* or the upper end portions 3*a* and 2*a*. The front end portion 5*b* of the seat supporting member 5 is connected by a pin 9 to the front end portion 7*a* of each arm supporting member 7. The rear end 7*b* of the arm supporting member 7 is connected to the rear end portions 5*a* of each seat supporting member 5 by means of a plate-like fixing member 10 which is secured to the portion 5*a*.

Stretched between the seat supporting members 5 is a collapsible seat 11 made of, for example, canvas. An arm 12 made of, for example, wood are fixedly mounted on each arm supporting member 7.

To the rear end portion 5*a* of each seat supporting member 5, there is fixed mechanism 14 for adjusting the inclination of the backrest. A backrest supporting member 15 is pivoted at its lower end 15*a* to each mechanism 14 so as to be foldable on the seat 11. A collapsible backrest 16 made of, for example, canvas is stretched between the backrest supporting members 15. The backrest 16 may of course be formed integrally with the seat 11. But it may provide the backrest 16 separately so that both the backrest 16 and the seat 11 need not be removed when only one of them becomes so dirty or is so broken that it must be replaced by a clean or new one.

Figure 5:
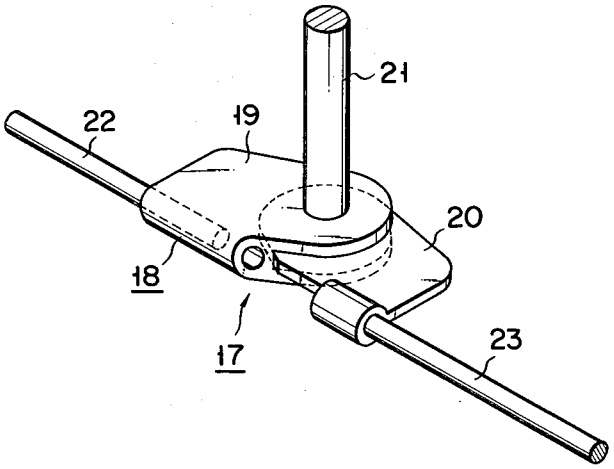
FIG. 5 is a perspective view of a hinge of a bracing member of the backrest.
Figure 4:
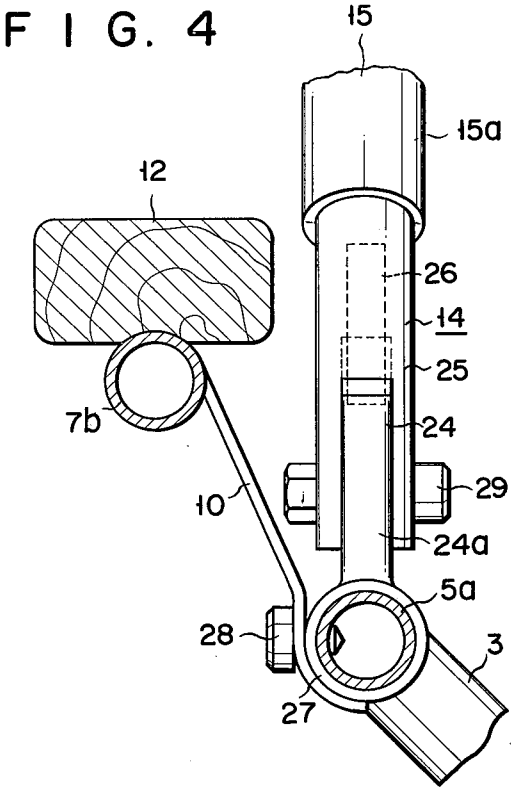
FIG. 4 shows the mechanism of FIG. 3 as seen from the front of the folding chair.

The upper ends of the backrest supporting members 15 may be connected by a brace 17 for holding a beach parasol, which can be folded at the middle portion. As shown in FIG. 5, the brace 17 comprises a hinge 18 having a pair of hinge members 19 and 20, and a pair of horizontal rods 22 and 23 attached at one end to the hinge members 19 and 20, respectively. The hinge members 19 and 20 are pivoted to a shaft 21 on which a beach parasol (not shown) is mounted. The other ends of the rods 22 and 23 are bent downwardly and are either secured to the respective upper ends of the backrest supporting members 15 or inserted into respective vertical holes made in those upper parts of the backrest 16 which are adjacent to the backrest supporting members 15.

Referring to FIGS. 1 to 4 (particularly to FIG. 3), it will be described the construction of the mechanism 14 for adjusting the inclination of the backrest 16. The mechanism 14 comprises a stationary cam 24 made of a plate, a connecting member 25 whose lower end is pivoted to the base portion 24*a* of the stationary cam 24 by means of a bolt-nut assembly 29, and a rocking cam 26 provided in and pivoted to the connecting member 25 and engageable selectively with one of the later described cam surfaces of the cam 24. The stationary cam 24 is integral with, or secured to, a sleeve 27 into which the rear end portion 5*a* of the seat supporting member 5 is inserted, and extends upward and inclined rearward of the chair. The sleeve 27 and the fixing member 10 are fixed to the rear end portion 5*a* of the respective seat supporting member 5. On the upper end of the stationary cam 24, there are provided cam surfaces 30 and 31 and a step 32 formed therebetween. The distance between the cam surface 30 and the axis of the bolt-nut assembly 29 is smaller than that between the cam surface 31 and the axis of the assembly 29.

Each connecting member 25 assumes a form of a sheath with the open lower end or a shallow channel member with flange portions cut off at their lower ends, so that the stationary cam 24 can abut against them. The rocking cam 26 is pivoted to the connecting member 25 by a shaft 33. The lower end of the rocking cam 26 has a cam surface 34 which selectively contacts the cam surface 30 or 31 of the stationary cam 24. As the rocking cam 26 is rocked counterclockwise, its upper front portion 35 comes into contact with the inner wall of the front portion or front flange 37 of the connecting member 25. As the rocking cam 26 swings clockwise, its upper rear portion 36 comes into contact with the inner wall of the rear portion or rear flange 38 of the connecting member 25.

Figure 3:
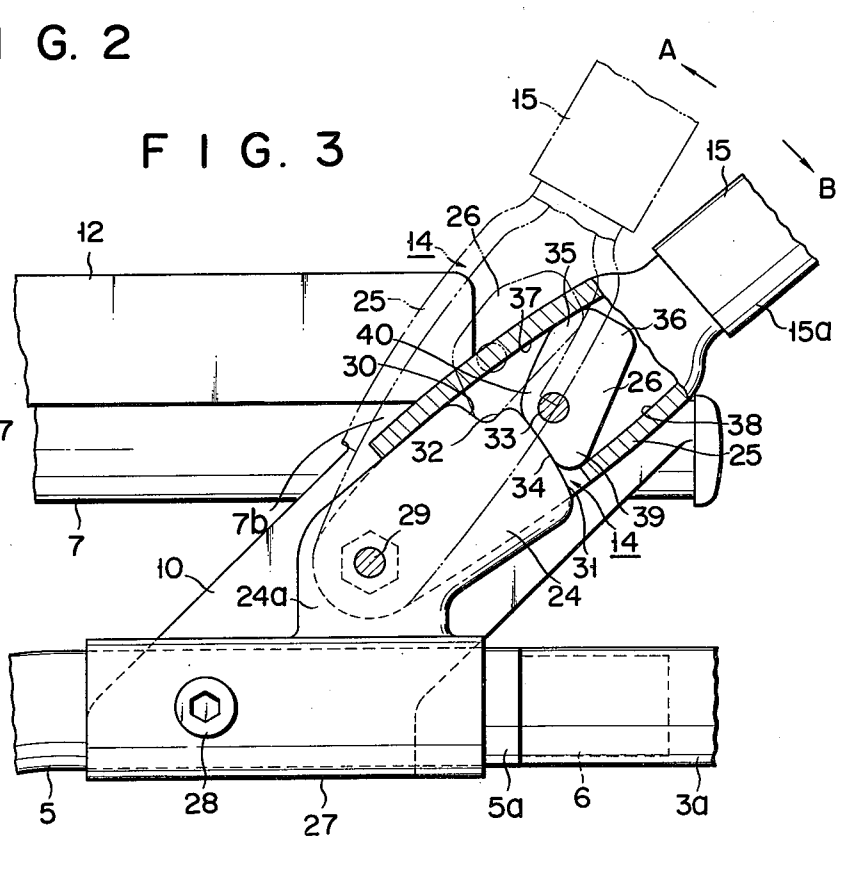
FIG. 3 is a partially broken view of a mechanism for adjusting the inclination of the backrest.

When the backrest supporting member 15 is inclined backward at the largest angle as illustrated by solid lines in FIG. 3, the upper front portion 35 of the rocking cam 26 contacts the inner wall of the front flange 37 of the connecting member 25, and the cam surface 34 of the cam 26 engages the cam surface 31 of the stationary cam 24. The cam surface 34 of the rocking cam 26 is so formed that the distance between it and the shaft 33 progressively increases rearwardly of the chair. The cam surface 30 of the stationary cam 24 is so positioned as to receive a lower rear edge portion 39 of the rocking cam 26, when the connecting member 25 (i.e., the backrest 16) is moved in the direction of the arrow A to the position indicated by the chair lines.

With reference to FIGS. 1 to 3, it will now be described how the mechanism 14 works to adjust the inclination of the backrest 16. Suppose the weight of a user sitting on the chair exerts on the backrest 16, thereby applying force on the connecting member 25 in the state depicted by the solid lines in FIG. 3, in the direction of the arrow B. The force is transmitted from the connecting member 25 to the cam surface 31 of the stationary cam 24 by the rocking cam 26. The reaction from the cam surface 31 pushes the cam surface 34 of the rocking cam 26 counterclockwise as viewed in FIG. 3. As a result, the upper front portion 35 of the rocking cam 26 pushes the inner wall of the front portion or front flange 37 of the connecting member 25 with a force equal to the force which exerts on the inner wall of the front portion or flange 37 to push the member 25 clockwise. Both forces on the front portion or flange 37 thus cancel each other, and the backrest 16 is not further inclined backwardly.

As the backrest 16 is swung in the direction of the arrow A, the lower rear edge portion 39 of the rocking cam 26 comes into contact with the cam surface 30 of the stationary cam 24. As the backrest 16 is moved backward (i.e., in the direction of the arrow B), the connecting member 25 moves also backward a little until a lower front portion 40 of the rocking cam 26, which is adjacent to the cam surface 34, abuts against the inner wall of the front portion or front flange 37 of the connecting member 25. Then, the backrest 16 is not further inclined backward even if a force such as the user's weight exerts on it in the direction of the arrow B, since such a force is cancelled by the reaction from the cam surface 30 and the step 32 of the stationary cam 24 by the rocking cam 26.

When the backrest 16 is further moved in the direction of the arrow A, the rocking cam 26 is released from the cam surface 30 of the stationary cam 24. If this movement is quickly done, the rocking cam 26 rotates counterclockwise to allow its upper front portion 35 to hit the inner wall of the front portion or flange 37 of the connecting member 25. While the backrest 16 is moved slowly in the direction of the arrow B, the upper front portion 35 of the rocking cam 26 remains in contact with the inner wall of the front portion or flange 37 of the connecting member 25. Finally, the connecting member 25 (i.e., the backrest 16) is disposed again in such a position as depicted by the dotted lines. In this way, the backrest 16 can be inclined selectively at two angles.

The backrest 16 may be inclined selectively at three or more angles by properly shaping the cam surface of the stationary cam 24.

The backrest 16 can be folded on the seat 11. Further, the backrest 16 and the seat 11 can be collapsed along their common central line, when the legs 1 are caused to approach each other as shown by the dotted lines in FIG. 2. The chair can therefore be collapsed more compactly than the known folding chair whose backrest protrudes from the legs even after the chair has been folded. Once collapsed so compact, the foldinng chair according to this invention can be easy to carry or transport and can be put in a smaller space.

Moreover, the upper front end portions 3*a* of the legs 1 and the rear end portions 5*a* of the seat supporting members 5 are connected by means of the cylindrical or tubular connectors 6. Since the connectors 6 of this kind are stronger than conventional bolts or pins, the connection between the legs 1 and the seat supporting members 5 is not so easily damaged than in case the legs 1 and the members 5 are connected by bolts or pins.

What is claimed is:

1. In a folding chair comprising a pair of generally U-shaped tubular legs pivoted to each other at middle points of arm portions thereof, a pair of seat supporting members each having end portions connected to corresponding upper end portions of a respective one of said legs, a collapsible seat stretched between said seat supporting members, a pair of arm supporting members provided above said seat supporting members, a pair of arms mounted on the respective arm supporting members, a pair of backrest supporting members each mounted over a respective one of said legs so as to be foldable on said seat supporting members, and a collapsible backrest stretched between said backrest supporting members, the improvement comprising:

cylindrical connectors inserted into those end portions of said seat supporting members and those upper end portions of said legs which are adjacent to said backrest supporting members for connecting said seat supporting members to said legs, and a pair of backrest inclination adjusting mechanisms between said adjacent end portions of said seat supporting members and lower ends of said backrest supporting members, each of said backrest inclination adjusting mechanisms comprising a stationary cam mounted on said adjacent end portion of said seat supporting member and having stepped cam surfaces formed on an end thereof which is remote from said adjacent end portion of said seat supporting member, a connecting member having one end pivoted to a base portion of said stationary cam and another end fixed to the lower end of said backrest supporting member, a rocking cam pivoted to said connecting member and having a cam surface selectively engageable with one of said cam surfaces of said stationary cam, and control means disposed in said connecting member for controlling the rocking movement of said rocking cam.

2. The folding chair according to claim 1, wherein said cam surface of said rocking cam has such a configuration that the distance between said cam surface of said rocking cam and a pivotal point of said rocking cam to said connecting member increases rearwardly of said chair.

3. The folding chair according to any one of claims 1 and 3, wherein the distance between that cam surface of said stationary cam which is nearer to the back of said chair than the other cam surface thereof and a pivotal point of said connecting member to said stationary cam is larger than the distance between said other cam surface of said stationary cam and said pivotal point of said connecting member.

4. The folding chair according to any one of claims 1 or 3, wherein said connecting member comprises a sheath-like member and said control means comprises front and rear walls of said connecting members.

5. The folding chair according to any one of claims 1 or 3, wherein said connecting means comprises a shallow channel member and said control means comprises a pair of flanges of said connecting member.

6. The folding chair according to claim 4, wherein said connecting member comprises a sheath-like member and said control means comprises front and rear walls of said connecting members.

7. The folding chair according to claim 4, wherein said connecting means comprises a shallow channel member and said control means comprises a pair of flanges of said connecting member.

* * * * *